US007032907B1

(12) United States Patent
Marsh

(10) Patent No.: US 7,032,907 B1
(45) Date of Patent: Apr. 25, 2006

(54) CREEPER

(76) Inventor: Paul H. Marsh, 1269 Old Salem Rd., Kernersville, NC (US) 27284

( * ) Notice: Subject to any disclaimer, the term of this patent is extended or adjusted under 35 U.S.C. 154(b) by 540 days.

(21) Appl. No.: 10/093,008

(22) Filed: Mar. 7, 2002

(51) Int. Cl.
*B25N 5/00* (2006.01)

(52) U.S. Cl. ..... 280/32.6; 280/32.5; 280/47.131; 280/79.11; 280/79.7

(58) Field of Classification Search ..... 280/32.5, 280/32.6, 47.131, 79.11, 79.7
See application file for complete search history.

(56) References Cited

U.S. PATENT DOCUMENTS 958,347 A * 5/1910 Younglove ..... 280/30
1,687,948 A * 10/1928 Olsen ..... 280/32.5
2,104,372 A * 1/1938 Matthies ..... 280/32.6
4,792,147 A * 12/1988 Wissing ..... 280/32.6
4,986,558 A * 1/1991 Morris ..... 280/32.6
5,022,670 A * 6/1991 Cote et al. ..... 280/32.6
5,213,350 A * 5/1993 Hermanson ..... 280/32.6
5,318,312 A * 6/1994 Montemayor ..... 280/30
5,330,211 A * 7/1994 Nicholson ..... 280/32.6
5,853,180 A * 12/1998 Taylor ..... 280/32.6
6,238,069 B1 * 5/2001 Miles ..... 362/486
6,540,378 B1 * 4/2003 Alsup ..... 362/253

* cited by examiner

*Primary Examiner*—Christopher P. Ellis
*Assistant Examiner*—Kelly E Campbell

(57) ABSTRACT

A creeper having a pair of relatively large diameter wheels is provided for maneuverability along uneven surfaces. A torso support and extensions are positioned on a tubular frame. Approximately midway along the longitudinal length of the torso support is an axle for mounting of the wheels along each side. A pair of battery powered lights are positioned on the extension handles at the front end of the creeper and therebetween a retractable shelf resides for use by a worker such as when in a crawl space beneath a house.

8 Claims, 5 Drawing Sheets

CREEPER

FIELD OF THE INVENTION

The invention herein pertains to manually propelled vehicles and particularly pertains to creeper type vehicles having a low profile for movement in confined areas.

DESCRIPTION OF THE PRIOR ART AND OBJECTIVES OF THE INVENTION

Various types of creepers have been utilized over the years which allow users to move in areas with very little headroom such as under the bodies of vehicles. Mechanics usually lay on creepers in a supine posture to view the chassis or other vehicle components. Such creepers generally have four (4) relatively small diameter wheels for movement on hard surfaces such as concrete garage floors or other smooth, dense surfaces. These creepers are not suitable for operation on uneven surfaces such in grassy yards, dirt floors or the like since small diameter wheels will not efficiently operate thereon.

In addition to the need by mechanics for manually propelled, low profile transportation, many other workers are likewise subjected to confined areas for particular tasks and could benefit from similar transportation. Specifically, in the construction and building trades, workers are frequently required to work in dark, dirty, cramped crawl spaces, under homes and buildings while engaging in plumbing, HVAC, electrical, masonry, carpentry and other trades. As crawl spaces and other building areas usually have uneven, dirt or natural surfaces, conventional creepers will not properly operate, requiring the workers to crawl when beneath the buildings.

Thus, based on the problems and difficulties encountered in maneuvering over uneven surfaces in confined spaces, the present invention was conceived and one of its objectives is to provide a creeper which will work effectively on uneven earthen (dirt) surfaces while not creating air contaminants during use.

It is another objective of the present invention to provide a creeper which has one (1) pair of relatively large diameter, independent bearing wheels to allow the worker to pivot the creeper when stationary and to easily propel and steer the creeper over uneven surfaces.

It is yet another objective of the present invention to provide a creeper in which a worker can operate in either a prone or supine posture while elevated from a dirty crawl space floor to a desirable vantage point.

It is still another objective of the present invention to provide a creeper which includes a light and a shelf which can be extended or retracted as needed.

It is a further objective of the present invention to provide a creeper which is relatively inexpensive to manufacture and yet which is durable and dependable.

Various other objectives and advantages of the present invention will become apparent to those skilled in the art as a more detailed description is set forth below.

SUMMARY OF THE INVENTION

The aforesaid and other objectives are realized by providing a creeper having a pair of wheels with relatively large diameters. The wheels are independent and rotatably affixed to an axle with bearings on each side of a tubular frame. Attached to the top of the tubular frame is a planar torso support. The axle for the wheels is attached laterally at the approximate midpoint of the torso support. On each side of the front of the torso support is an extension which maintains an upright handle which can be used for gripping during maneuvering of the creeper. A rotatable battery powered light is affixed at the top of each handle to assist a worker in observation while in darkened areas. An extendable shelf is positioned below the torso support in front of the wheels. Behind the wheels attached to the torso support are storage compartments for containing small tools, writing instruments or other items. Atop the torso support is a cushion to provide comfort to the worker as he lays thereon.

DETAILED DESCRIPTION OF THE PREFERRED EMBODIMENT AND OPERATION OF THE INVENTION

Figure 1:
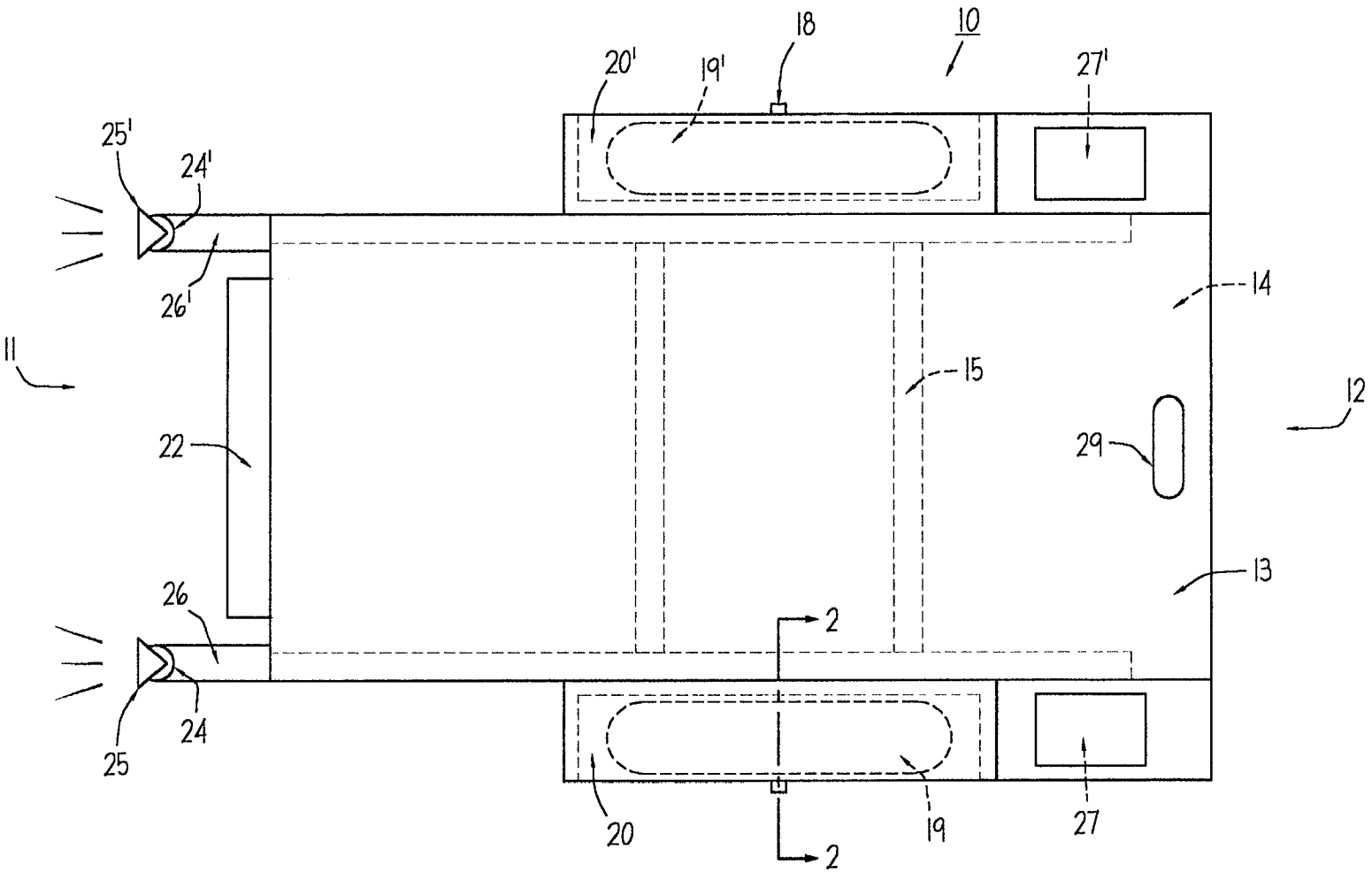
FIG. 1 shows a top view of the creeper described herein with the front shelf in a retracted posture.
Figure 2:
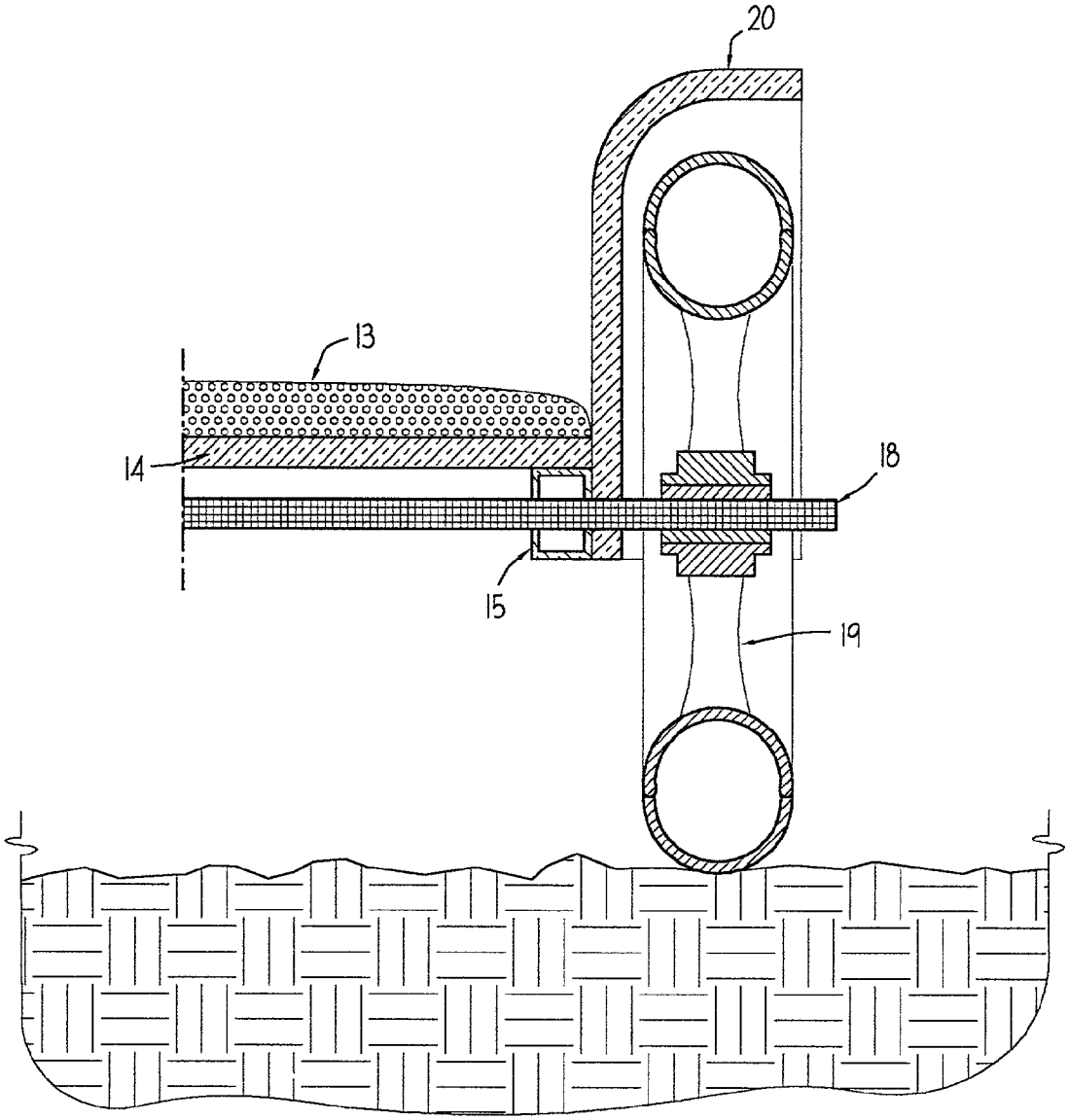
FIG. 2 depicts an enlarged view of the right side wheel as shown in FIG. 1 along lines 2—2.

For a better understanding of the invention and its operation, turning now to the drawings, FIG. 1 illustrates preferred creeper 10 having a front end 11 and rear end 12. Cushion 13 covers rectangular torso support 14 and is preferably vinyl covered polymeric foam such as polyurethane foam. Cushion 13 is preferably attached to torso support 14 as shown in FIG. 2 by a suitable adhesive though other means for fastening may be used. Torso support 14 is preferably formed from an aluminum sheet one-quarter inch thick (0.63 cm) for rigidity and is affixed to creeper frame 15 preferably by bolting thereto. Frame 15 as shown in FIGS. 1 and 2 is preferably formed of rectangular aluminum tubing although other materials may be used in place thereof such as steel tubing, wood or synthetic materials.

As also shown in FIGS. 1 and 2, axle 18 is attached laterally to and defines a midpoint along the longitudinal length of torso support 14. Axle 18 is preferably formed from a one-half inch (1.27 cm) steel rod. Axle 18 acts as a fulcrum to allow torso support 14 to pivot therearound as required as further shown in FIG. 4. Wheels 19, 19' are rotatably mounted on axle 18 and are covered respectively by fenders 20, 20', also shown in FIG. 1.

Figure 3:
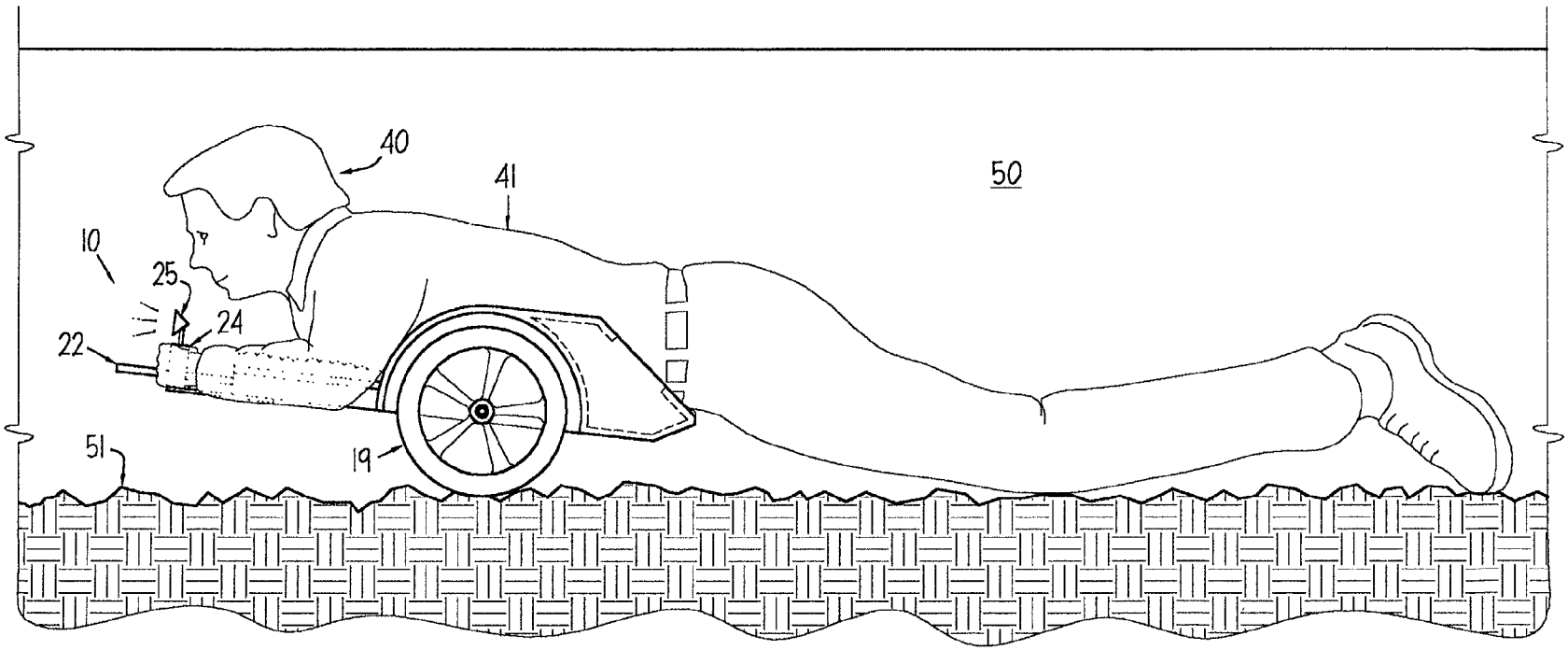
FIG. 3 illustrates a reduced side elevational view of the creeper as shown in FIG. 1 with a worker in a prone position thereon.
Figure 4:
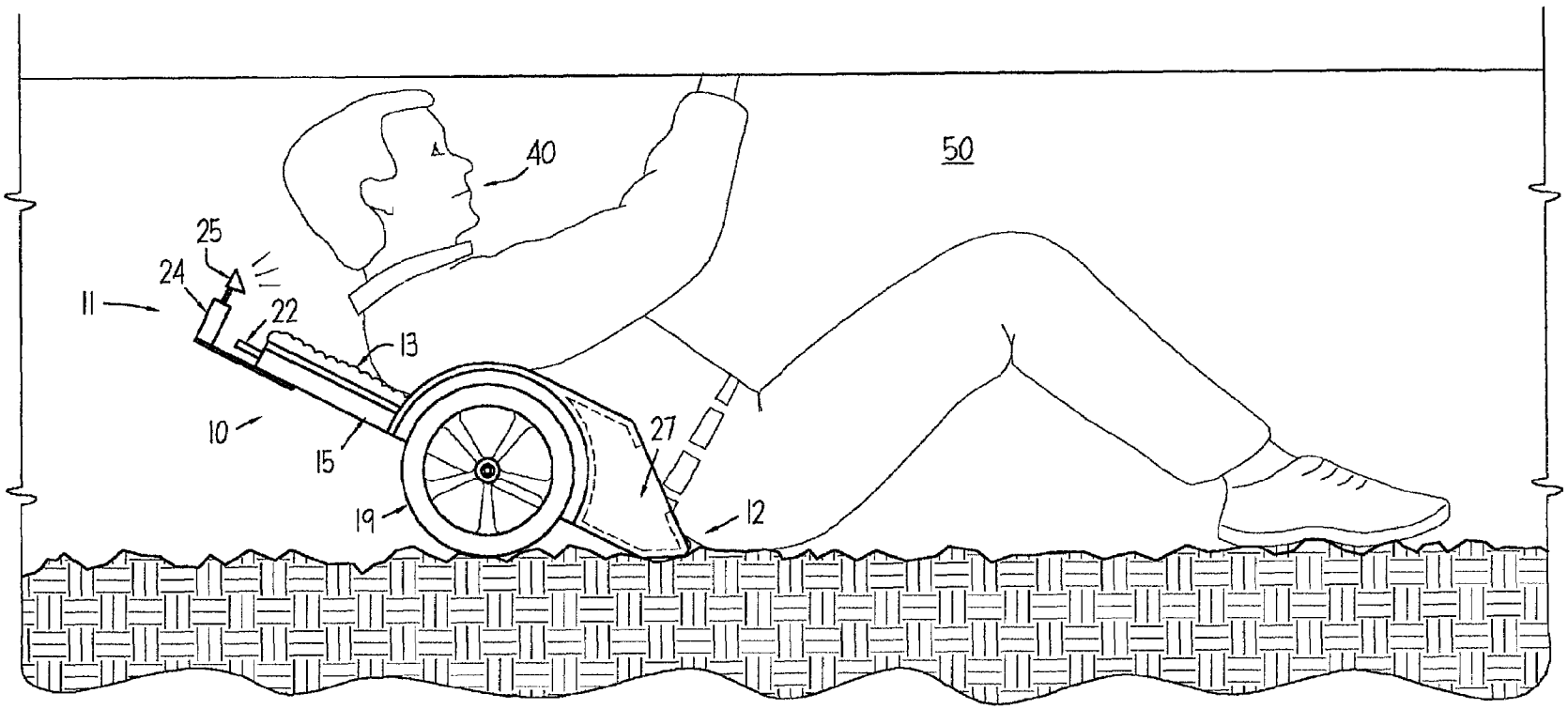
FIG. 4 demonstrates another view of the creeper but in a stationary posture with the worker in a somewhat supine position.

Shelf 22, seen in FIGS. 1, 3 and 4 is preferably formed of a rigid, lightweight plastic and is slidably mounted beneath torso support 14 by conventional furniture hardware such as extruded aluminum C-shaped brackets (not seen) to allow shelf 22 to extend as shown in FIG. 3 for writing or for other purposes. Shelf 22 when not in use can be slid or retracted beneath torso support 14 as shown in FIGS. 1 and 4 where it remains ready for future use.

In FIG. 3, worker 40 is propelling creeper 10 forward beneath a house or other building in crawl space 50 which includes uneven dirt floor 51. However, due to the large diameters of wheels 19, 19' (19' not seen in FIG. 3) worker 40 can easily maneuver creeper 10 by pushing with his feet and legs. Wheels 19, 19' extend above torso support 14 but are lower than the top of torso 41 of worker 40 thereon as seen in FIG. 3. As would be understood from FIG. 3, creeper 10 is relatively short compared to the length of worker 40 and extends longitudinally from about the face of worker 40 along torso 41 and is balanced by his body weight and legs as he maneuvers along. Handles 24, 24' (FIG. 1) attached respectively to extensions 26, 26' are grasped by worker 40 with battery powered lights 25, 25' being turned on and in a direction to assist observation while in crawl space 50. Extensions 26, 26' are affixed to torso support 14. Lights 25, 25' can be rotated as needed to provide light, generally in any desired direction. Batteries (not seen) are contained within handles 24, 24'. Shelf 22 in FIG. 3 is shown in an extended posture for writing on or other purposes as required by worker 40.

Figure 5:
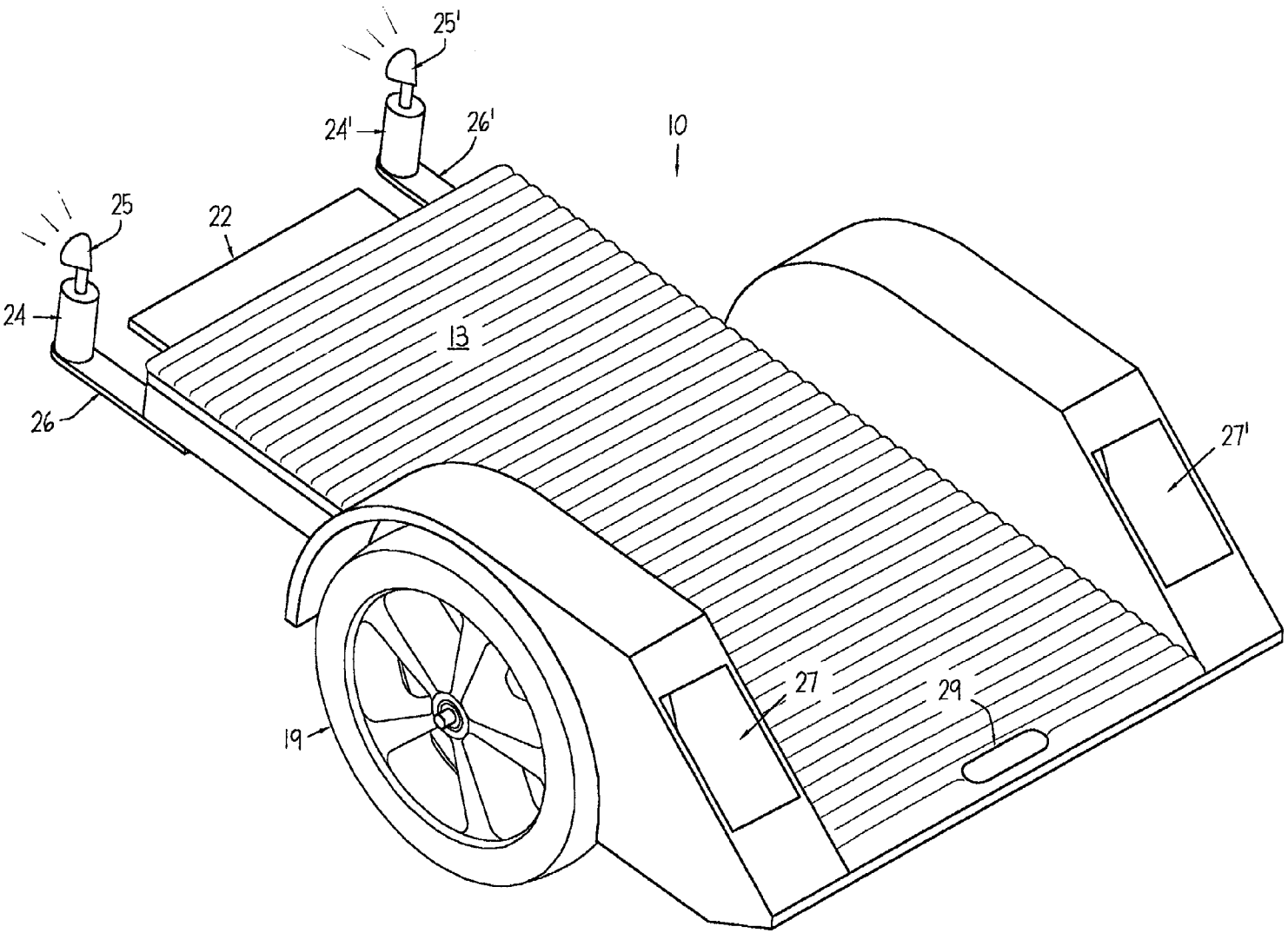
FIG. 5 pictures a rear perspective view of the creeper with the worker absent therefrom.

In FIG. 4 shelf 22 is seen in a retracted posture as worker 40 is supported along his back while creeper 10 remains stationary. By having only one (1) pair of wheels 19, 19', creeper 10 is easily tilted or pivoted into the stationary position seen in FIG. 4 with rear end 12 resting on floor 51 while front end 11 extends upwardly. Storage compartments 27, 27' are now easily accessible to worker 40 while thusly positioned on creeper 10. In FIG. 5, opening 29 defined in torso support 14 is useful for grasping creeper 10 for removal from crawl space 50 or for other handling needs.

The illustrations and examples provided herein are for explanatory purposes and are not intended to limit the scope of the appended claims.

I claim:

1. A creeper for propelling an individual in a substantially horizontal posture comprising: a torso support, said torso support shorter than the length of the individual to allow the legs of the individual to extend beyond said torso support, a pair of extensions, said extensions attached to and forward of said torso support, a pair of handles, each of said handles attached to different ones of said extensions, an extendable shelf, said shelf attached to said torso support, said shelf extendable forwardly between said extensions, a pair of wheels, one of said pair of wheels attached to said torso support along each side, said wheels positioned approximately midway along the longitudinal length of said torso support whereby the individual can mount the torso support between said wheels and pivot said creeper as desired.

2. The creeper of claim 1 further comprising a storage compartment said storage compartment positioned proximate one of said wheels above said torso support.

3. The creeper of claim 1 wherein said torso support is formed of aluminum.

4. A creeper for manually propelling a horizontal worker comprising: a torso support, an extension, said extension affixed to said torso support and extending forwardly therebeyond, a handle, said handle attached to said extension for maneuvering said creeper, an extendable shelf, said shelf-attached to said torso support, said shelf extendable forwardly along said extension, a pair of wheels, each of said pair of wheels attached along different sides of said torso support to allow said individual to propel said creeper using his legs and to pivot said creeper as desired.

5. The creeper of claim 4 wherein said wheels each extend above said torso support while resting on the ground.

6. The creeper of claim 4 further comprising an axle, said axle defining a fulcrum for said torso support.

7. The creeper of claim 4 further comprising a pair of storage compartments, each of said storage compartments attached to said torso support behind different ones of said wheels.

8. The creeper of claim 4 further comprising a light, said light attached to said handle.

* * * * *